US010640179B2

(12) United States Patent
Bonnaffoux et al.

(10) Patent No.: US 10,640,179 B2
(45) Date of Patent: May 5, 2020

(54) TURRET MOORING SYSTEM ARRANGEMENT

(71) Applicant: SINGLE BUOY MOORINGS INC., Marly (CH)

(72) Inventors: Guillaume Bonnaffoux, Bât. Aigue Marine (MC); Nicolas Fourdilis, Bât. Aigue Marine (MC)

(73) Assignee: SINGLE BUOY MOORINGS INC., Marly (CH)

( * ) Notice: Subject to any disclaimer, the term of this patent is extended or adjusted under 35 U.S.C. 154(b) by 0 days.

(21) Appl. No.: 16/092,349

(22) PCT Filed: Apr. 5, 2017

(86) PCT No.: PCT/EP2017/058130

§ 371 (c)(1),
(2) Date: Oct. 9, 2018

(87) PCT Pub. No.: WO2017/174665

PCT Pub. Date: Oct. 12, 2017

(65) Prior Publication Data

US 2019/0106183 A1 Apr. 11, 2019

(30) Foreign Application Priority Data

Apr. 16, 2016 (EP) ..... 16164045

(51) Int. Cl.
*B63B 35/44* (2006.01)
*B63B 21/50* (2006.01)
*E21B 43/01* (2006.01)

(52) U.S. Cl.
CPC ..... *B63B 35/4413* (2013.01); *B63B 21/507* (2013.01); *B63B 35/44* (2013.01); *E21B 43/01* (2013.01); *B63B 2035/448* (2013.01)

(58) Field of Classification Search
CPC ..... B63B 21/00; B63B 22/02; B63B 22/26; B63B 21/16; B63B 21/50; B63B 21/508;
(Continued)

(56) References Cited

U.S. PATENT DOCUMENTS 3,191,201 A 6/1965 Richardson et al.
4,436,048 A 3/1984 Gentry et al.
(Continued)

FOREIGN PATENT DOCUMENTS

WO 01/47768 A1 7/2001
WO 02/32753 A1 4/2002

OTHER PUBLICATIONS

International Search Report, dated Jul. 3, 2017, from corresponding PCT/EP2017/058130 application.

*Primary Examiner* — Lars A Olson
(74) *Attorney, Agent, or Firm* — Young & Thompson

(57) ABSTRACT

A turret mooring system for a floating process and storage offloading, FPSO, vessel or a FLNG vessel includes a turret structure and a bearing support structure. The turret structure is to be placed within a moonpool in a hull of the vessel and rotatably held within the moonpool via the bearing support structure. The bearing support structure includes a radial support and an axial support. The radial support includes a plurality of radial wheels, and the axial support includes a plurality of axial bogies. The vessel has a topside process deck and the turret structure includes a collar deck. The collar deck is positioned vertically above an upper side of the axial support and below an elevation of the topside process deck. An FPSO or FLNG vessel is provided which includes the turret mooring system.

19 Claims, 7 Drawing Sheets

(58) Field of Classification Search
CPC ..... B63B 35/00; B63B 35/44; B63B 21/507; B63B 35/4413; E21B 43/01
USPC ..... 114/230.12, 293; 441/3, 4, 5
See application file for complete search history.

(56) References Cited

U.S. PATENT DOCUMENTS

| | | | | |
|---|---|---|---|---|
| 5,240,446 | A | 8/1993 | Boatman et al. | |
| 5,359,957 | A * | 11/1994 | Askestad | B63B 21/507 114/230.12 |
| 6,990,917 | B2 * | 1/2006 | Boatman | B63B 21/507 114/230.12 |
| 8,397,655 | B2 * | 3/2013 | Braud | B63B 21/508 114/230.12 |
| 2003/0121465 | A1 | 7/2003 | Boatman et al. | |
| 2003/0154899 | A1 | 8/2003 | Cottrell et al. | |
| 2015/0122167 | A1 * | 5/2015 | Lunde | B63B 21/508 114/230.12 |

* cited by examiner

TURRET MOORING SYSTEM ARRANGEMENT

FIELD OF THE INVENTION

The present invention relates to a turret mooring system arrangement. Also, the invention relates to a vessel having such a turret mooring system arrangement.

BACKGROUND

Such a vessel is known from U.S. Pat. No. 4,436,048, which describes a vessel comprising a main deck and a turret moonpool which has a circular side and contains a rotary-powered turret having a circular turret side and a flanged turret top.

In offshore technology, vessels such as Floating Production Storage and Offloading vessels or Floating Storage and Offloading vessels or FLNGs (Floating Liquefied Natural Gas production) are typically moored by a turret mooring system. Turret mooring systems provide a turret mooring structure comprising a turret structure and a bearing arrangement with its support structure mounted on the vessel. The turret structure is anchored to the seabed with anchoring lines. The bearing support structure, provided on a vessel, has a receptacle for receiving the turret structure, such that rotation of the vessel about the turret structure is still possible. In this manner, the vessel can weathervane under influence of wind, waves, currents and/or drifting ice and adopt the position of least resistance with regards to the environment.

In addition to the anchoring lines, the turret structure supports one or more riser lines that are connected to wells on the seabed. Through the turret structure the riser lines are connected with process equipment and/or storage equipment on the vessel, allowing transportation of fluids, by establishing a flow path between the vessel and the subsea well.

The turret mooring structure may be an internal turret mooring structure or an external turret mooring structure.

An internal turret mooring structure is provided inside the hull of the vessel, in a so-called moonpool of the vessel. The moonpool receptacle is formed with an opening at or near the bottom of the vessel, facing downwards.

The turret mooring structure itself is connected to the vessel by the bearing arrangement and its support structure, which provide for rotation of the vessel with respect to the turret structure. The turret structure may be a mooring buoy that can be disconnected and reconnected when needed, thereby providing a disconnectable turret mooring system.

Top Mounted Internal Turrets have a bearing arrangement that relies on axial bogies and radials wheels components to allow the turret-moored vessel to weathervane. Axial bogies are designed to take the axial load transferred from the vessel to the turret. Radial wheels transfer the radial load from the vessel to the turret. Typically, the axial bogies are arranged between the radial wheels and a topside process deck of the vessel. On top of the axial bogies arrangement, a collar deck is provided. In the prior art, either no collar deck is present at all, or the axial bogies and radial wheels are positioned in such a manner that the collar deck is vertically close or adjacent to the topside process deck. The top side process deck is typically the deck of the vessel that lies just above the vessel's main deck, and generally holds processing modules used for oil separation, gas in and/or cleaning water before reinjection of the water into the well.

It is observed that due to upscaling in many offshore vessels the elevation of the topside process deck and of the bearing arrangement with respect to the keel has become large.

As FPSO/FLNG vessels have become larger, the elevation of the topside process deck above keel has increased to 40 meter or more. This has a direct effect on the loading of the bearing arrangement, i.e., an increase of the bending forces and moments exerted thereon. Thus such a bearing arrangement requires reinforcement of the axial bogies, resulting in larger and heavier designs and constructions. Such adaptations comprise the implementation of a turret cylinder and a bogie support structure up to the elevation of the topside process deck which implies that additional structures are required to cope with the large height of the vessel.

It is an object of the present invention to overcome or mitigate one or more of the disadvantages from the prior art.

SUMMARY OF THE INVENTION

The object is achieved by a turret mooring system for a floating process and storage operations, FPSO (or FLNG), vessel, comprising a turret structure and a bearing arrangement; the turret structure to be placed within a moonpool in a hull of the vessel and rotatably held within the moonpool via a bearing arrangement, the bearing arrangement comprising a radial support and an axial support; the radial support comprising a plurality of radial wheels, the axial support comprising a plurality of axial bogies; the vessel having a topside process deck, wherein the turret structure comprises a collar deck and the collar deck is positioned vertically above an upper side of the axial bogies and below the elevation of the topside process deck.

The collar deck of the turret is thus the first deck that lies at least partially above, and is supported by, the axial support, and which is adapted for supporting equipment and/or people thereon. The collar deck is typically accessible by personnel from a deck of said turret immediately above it, e.g. via stairs or an elevator, and may comprise a structural deck comprising an assembly of steel plates that have been welded together to form a floor of said collar deck.

Advantageously, the turret mooring structure provides that levels of the axial bogies and the radial wheels are located well below the topside process deck. Due to the relatively shorter distance of the bearing arrangement to the keel, this has the effect that the bending forces and moments on the turret structure are lower than would occur at the elevation level of the topside process deck. This allows to relax the requirements on the strength of the bearing elements, the turret structure and the bearing support structure. Moreover, since less reinforcements may be needed, the weight of the turret structure and the bogie support structure can be reduced as well.

As will be appreciated by the skilled in the art, the lever arm between the mooring chain connection point and the radial wheels, multiplied by the horizontal mooring load will give the level of moment applied to the bogie wheels. The lower the radial wheels, the shorter the lever arm and hence the moment applied on bogies.

According to an embodiment, the invention provides the turret mooring system as defined above, wherein the bearing support structure further comprises a plurality of lower stoppers arranged in a bottom region of the moonpool.

According to an embodiment, the invention provides the turret mooring system as defined above, wherein the lower stoppers are arranged at vertical distance of about 5 meter from the bottom opening of the moonpool.

According to an embodiment, the invention provides the turret mooring system as defined above, wherein the collar deck is separated from the topside process deck by at least one interdeck distance. Preferably, one or more further decks are arranged in the turret between the topside process deck and the collar deck, with the topside process deck substantially covering the upper side of the moonpool.

According to an embodiment, the invention provides the turret mooring system as defined above, wherein the collar deck is separated from the topside process deck by an intermediate element.

According to an embodiment, the invention provides the turret mooring system as defined above, wherein the intermediate element comprises at least one of a riser termination deck and a manifold structure.

According to an embodiment, the invention provides the turret mooring system as defined above, wherein risers terminate at either the collar deck or the top side process deck.

According to an embodiment, the invention provides the turret mooring system as defined above, wherein the radial support is vertically positioned in the turret structure between the collar deck and a bottom part of the hull, and the axial support is vertically positioned in the turret structure between the collar deck and the radial support.

According to an embodiment, the invention provides the turret mooring system as defined above, wherein the collar deck sits on the axial bogies of the axial support.

According to an aspect of the invention, the bearing arrangement is provided with water damming means between the level of the radial wheels and the level of the designed maximum draught line. According to an embodiment, the invention provides the turret mooring system as defined above, further comprising a lip seal and/or a water damming labyrinth between the radial support and the bottom of the hull.

According to an aspect of the invention, the radial wheels are located close to the water line of the designed maximum draught of the vessel, at a vertical distance high enough to prevent the mechanical elements constituting the radial wheels to be exposed to sea water under operating conditions of the vessel. According to an embodiment, the invention provides the turret mooring system as defined above, wherein the radial support is positioned above a designed maximum draught level, said maximum draught level accounting for the sea water dynamic motions, to prevent exposure of radial wheels mechanical components to sea water.

According to an aspect of the invention, the bearing arrangement is located in the dry at a minimum distance from the designed maximum draught line of the vessel. Advantageously this location prevents premature damage of the radial wheels by extended exposure to sea water. According to an embodiment, the invention provides the turret mooring system as defined above, wherein the radial support is constructed at the level to be above the designed maximum draught level.

According to an embodiment, the invention provides the turret mooring system as defined above, wherein the lip seal and/or water damming labyrinth is vertically positioned between the designed maximum draught level of the vessel and the level of the radial support.

According to an embodiment, the invention provides the turret mooring system as defined above, wherein a vertical distance between the axial support and the radial support is between about 0 and about 10 meter.

According to an embodiment, the invention provides the turret mooring system as defined above, wherein the hull has a height of at least 35 meter between the bottom and the topside process deck.

According to an embodiment, the collar deck comprises a collar on the outer surface of said turret, wherein a lower side of said collar is adapted to be arranged on and axially supported by said axial bearing support.

According to an embodiment the collar deck comprises a floor, sidewalls and a ceiling, and is accessible from another deck of the turret which lies directly above the collar deck, preferably via stairs. The collar deck is thus not simply a flange of a turret via which the turret is supported on an axial bearing. The floor, when projected onto a horizontal plane, typically covers at least 70%, more preferably at least 85%, of the area of the collar deck between the side walls. This allows personnel inside the collar deck to walk from one end to another end of the collar deck across the floor to another end of the collar deck. Typically, according to the invention, most or all decks of the turret which lie below the topside process deck are provided with a floor, sidewalls and a ceiling.

According to an embodiment, the invention provides the turret mooring system as defined above, wherein the turret structure is disconnectable.

According to an embodiment, the invention provides the turret mooring system as defined above, wherein the turret structure is a mooring buoy.

Advantageous embodiments are further defined by the dependent claims.

BRIEF DESCRIPTION OF DRAWINGS

The invention will be explained in more detail below with reference to drawings in which illustrative embodiments thereof are shown. The drawings are intended exclusively for illustrative purposes and not as a restriction of the inventive concept. The scope of the invention is only limited by the definitions presented in the appended claims.

DETAILED DESCRIPTION OF EMBODIMENTS

Figure 1A:
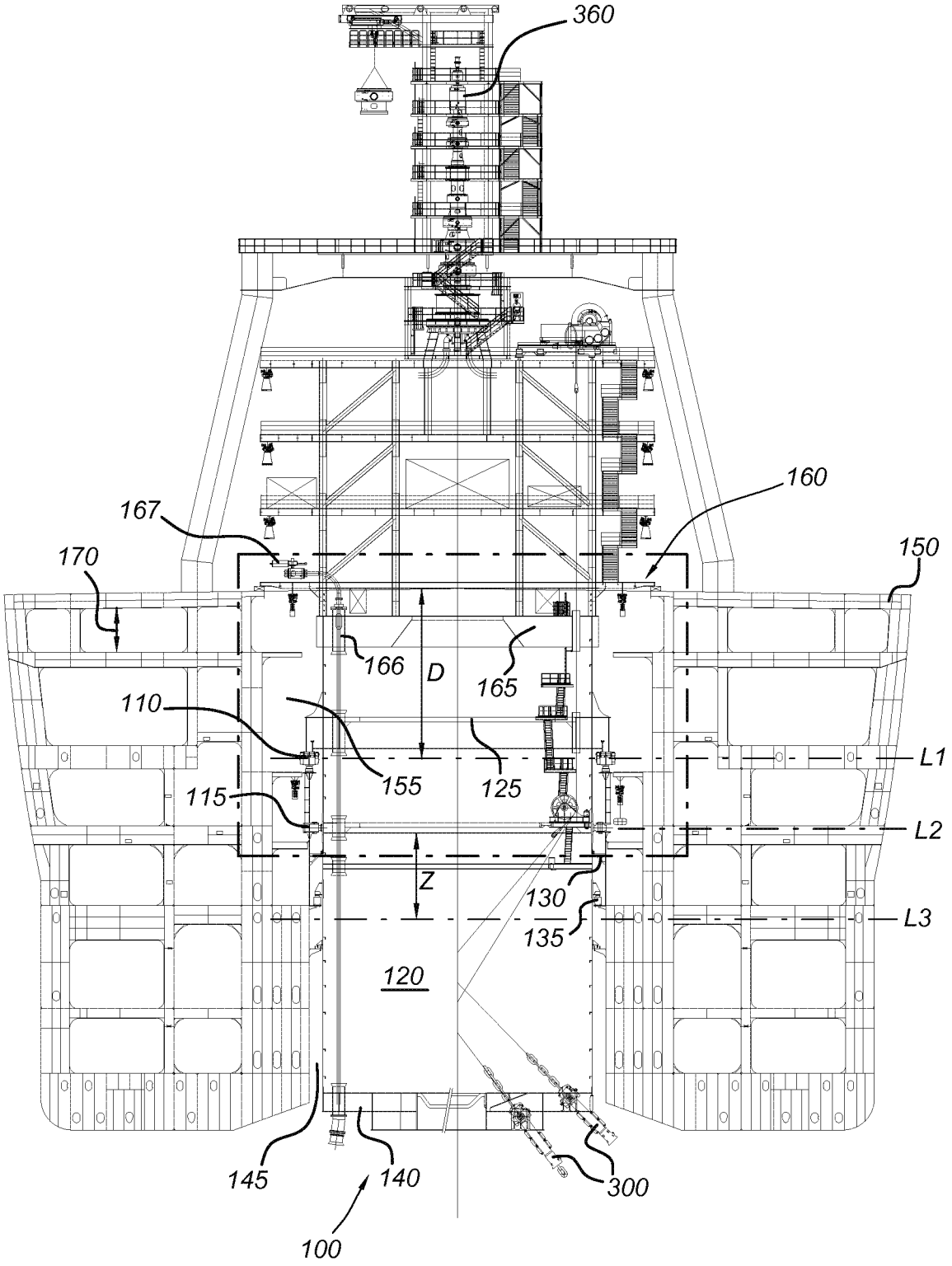
FIG. 1A shows a cross-sectional view of a vessel comprising a turret mooring system according to an embodiment of the invention.

FIG. 1A shows a cross-section of a vessel comprising a turret mooring system 100 according to an embodiment of the invention.

The turret mooring system 100 is arranged in an offshore vessel 150, which may be a Floating Storage and Offloading (FSO) vessel or a Floating Production Storage and Offloading (FPSO) vessel or a FLNG, or other type of vessel equipped for receiving an internal turret. The offshore vessel is typically moored at sea at a location in an offshore oil and/or gas field.

The turret mooring system 100 comprises in a moonpool 155 of the offshore vessel 150 a bearing arrangement 110, 115, which is arranged to accommodate an internal turret 120. The turret 120 is typically connected at its lower end, i.e., the chain table, to mooring or anchoring lines that are attached to the seabed.

When the turret 120 is positioned in the moonpool 155, the vessel 150 is thus in a moored position. In this position, the bearing arrangement 110, 115 allows rotation of the vessel 150 about a substantially vertical central axis, thus providing the vessel with a capability to weathervane under influence of waves, wind, etc.

The bearing arrangement 110, 115 comprises an axial support 110 comprising a plurality of axial bogies positioned at a first vertical bearing level L1 and a radial support 115 comprising a plurality of radial wheels at a second vertical bearing level L2. The second bearing level L2 is positioned below the first bearing level L1.

The axial bogies are designed to take an axial load transferred from the vessel 150 to the turret 120, and the radial wheels are configured to transfer a radial load from the vessel to the turret.

In the embodiment as shown in FIG. 1A, the bearing arrangement 110, 115 is positioned at vertical distance D below the elevation level of a topside deck 160 of the vessel 150, such that there is at least an interdeck space 170 between the topside process deck 160 and the top level, i.e., the first level L1 of the bearing arrangement 110, 115. An interdeck space is defined as a vertical distance between two successive decks within the hull of the vessel 150, which is large enough to locate relevant equipment, such as process equipment.

One interdeck space has a typical vertical distance of at least 5-6 meters.

In this manner, the bearing arrangement 110, 115 is positioned relatively closer to the keel 180 of the hull and closer to a level of the chain table 140 of the turret 120 where the mooring lines 300 are connecting with the turret structure 120. In this manner the bending forces and moments on the turret structure are relatively reduced. The elevation (second level L2) of the radial wheels (with respect to the keel 180/chain table 140) has effect on the load on the axial bogies in the axial support 110.

In an embodiment, the bearing arrangement 110, 115 is positioned close to a designed maximum draught line L3, which is based on the maximum draught of the vessel under full load.

The level L3 of the maximum draught line is below the second level L2 of the radial support. The radial support 115 is positioned in the dry at a distance Z from the draught line L3 in order prevent the radial wheels to be exposed to the sea water.

In an embodiment, the radial support 115 is positioned at some vertical distance Z above the designed maximum draught line L3.

Figure 2:
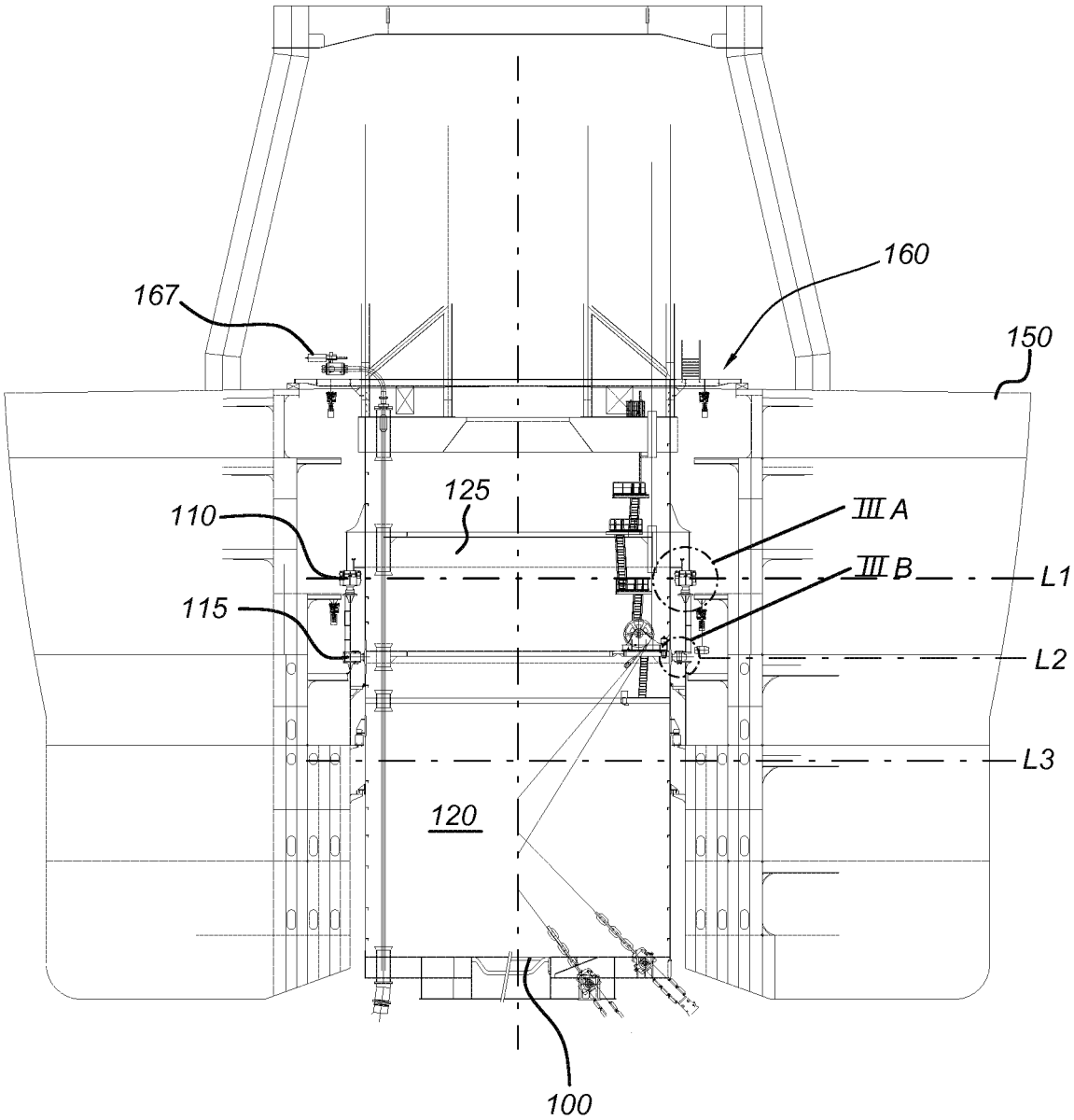
FIG. 2 shows a cross-sectional view of a detail from FIG. 1A.

The skilled in the art will appreciate that the vertical distance Z will vary with inter alia operating conditions, the vessel type, and regional weather and/or swell conditions depending on the location of the vessel. The vertical distance may be between about 5 and about 10 meter. In FIG. 2 a simplified cross-sectional view of FIG. 1A is presented, indicating the vessel 150, the turret 100, the bearing arrangement 110, 115. Further the levels of the axial bogie 110, of the radial wheels 115 and the maximum draught line are shown indicated by lines referenced L1, L2 and L3, respectively.

Figure 3A:
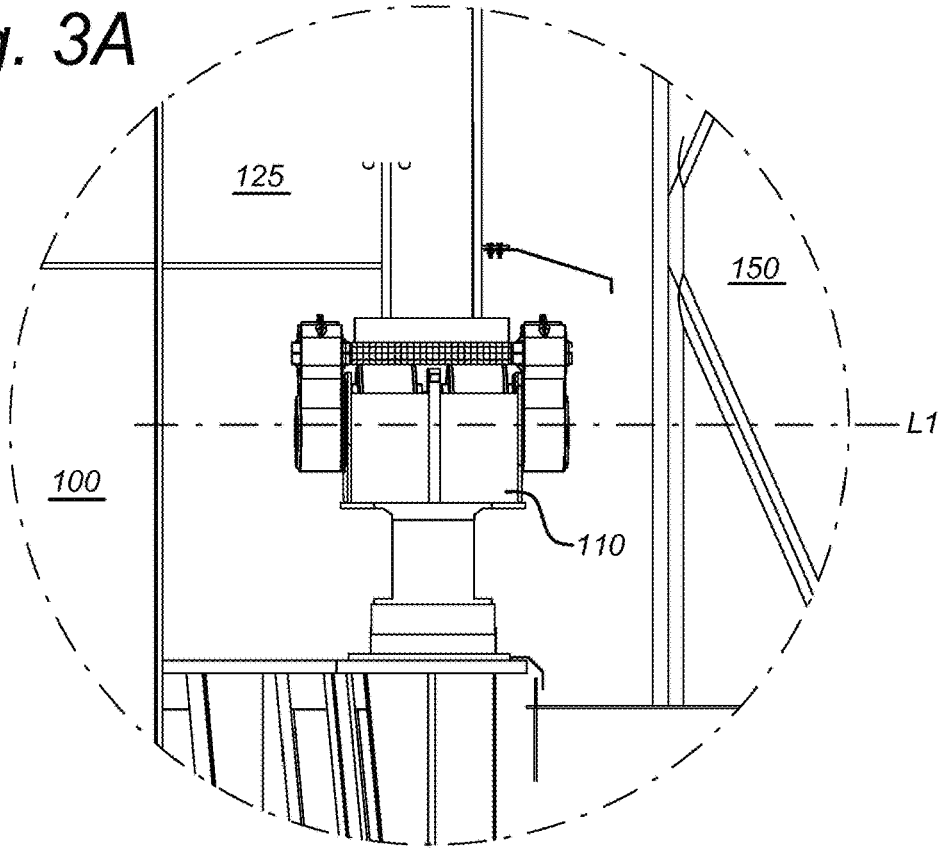
FIGS. 3A and 3B show details of a bearing structure.
Figure 3B:
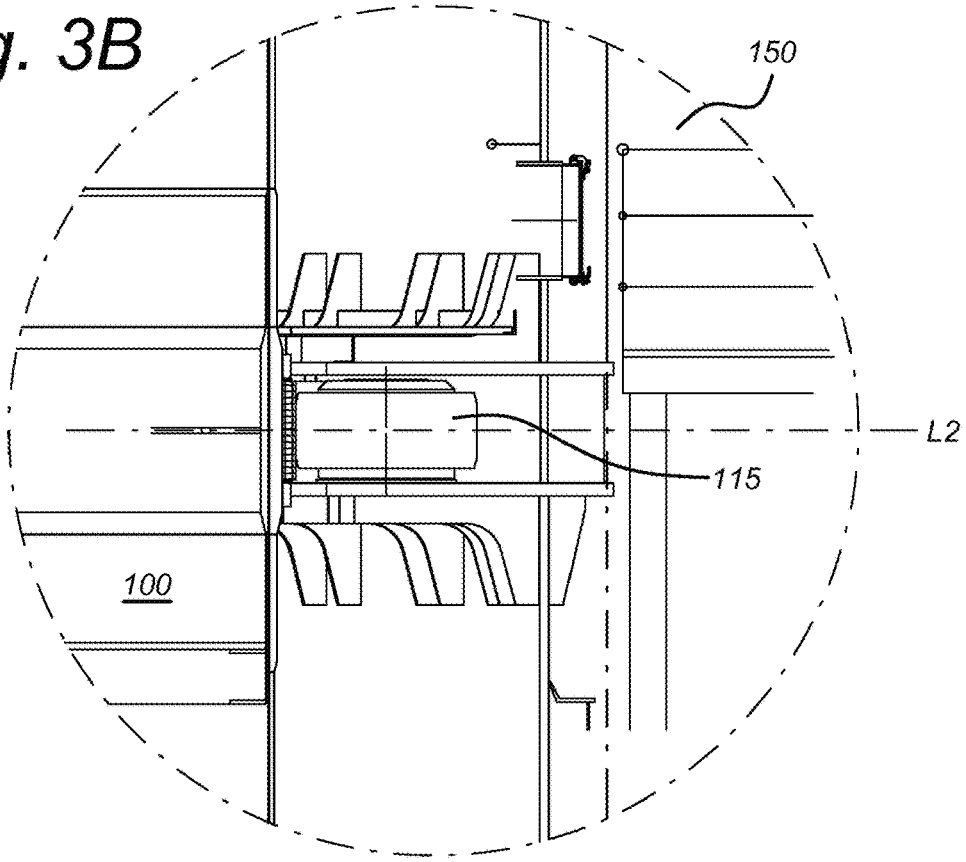

FIGS. 3A and 3B show details of the bearing structure. In FIG. 3A the axial bogie 110 is shown, positioned on the internal moonpool wall under the collar deck 125. In FIG. 3B an arrangement of radial wheels 115 on the internal moonpool wall is shown.

Referring again to FIG. 1A, in a further embodiment, the bearing arrangement 110, 115 is provided with a lip seal 130 between the maximum draught line L3 and the level L2 of the radial support 115, to protect the radial support against sloshing of water in the gap 145 between the moonpool 155 and the turret structure 120.

Additionally or alternatively, a water damming means can be provided for the same purpose between the maximum draught line L3 and the level L2 of the radial support 115. In an embodiment, the water damming means comprises a water labyrinth 135 that prevents sloshing water to reach the radial support.

In an embodiment, the lip seal 130 and water labyrinth 135 are applied in combination, in which the water labyrinth 135 is positioned vertically between the draught line L3 and the level of the lip seal 130.

Further, a collar deck 125 is provided that substantially sits on the axial support/axial bogies 110. The collar deck 125 enables transfer of axial loads from the axial bogies to the vessel via the bearing system. Typically the collar deck is a structural deck with relatively high stiffness that sits on the axial bogies.

Figure 1B:
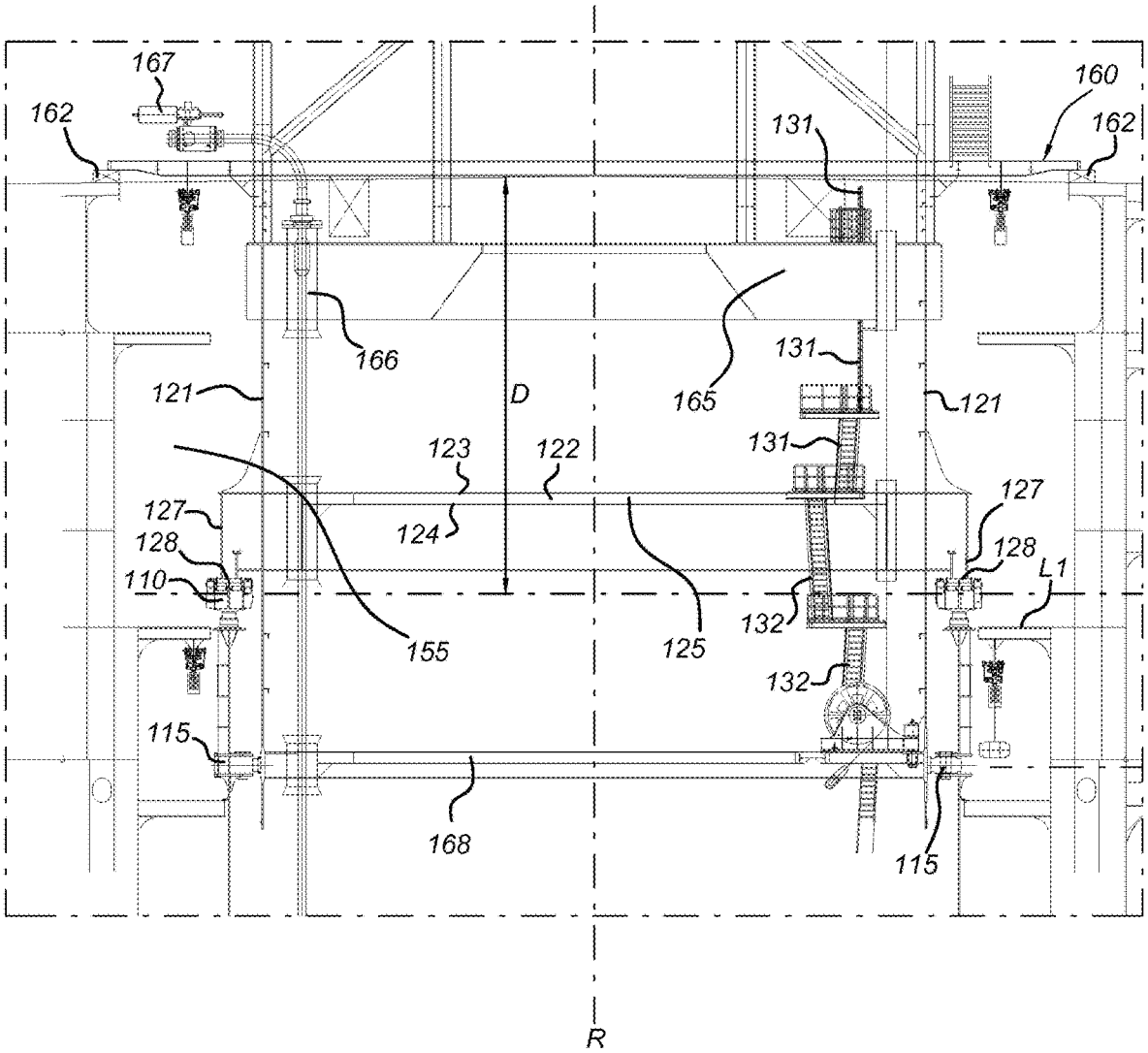
FIG. 1B shows a detail of the collar deck of FIG. 1A.

FIG. 1B shows the collar deck 125 of FIG. 1A in greater detail. The collar deck is provided with a collar 127 on the outer surface 121 of the turret 120, wherein a lower side 128 of the collar 127 is arranged on the axial bearing supports 110. When the turret rotates around its axis of rotation R relative to the moonpool 155, the lower side of the collar is moved relative to the axial bearing supports 110. Above the lower side 128, the collar deck comprises a floor 122 having a top surface 123 on which equipment may be arranged and across which personnel may move, and having a bottom side 124 which may act as a ceiling for the deck 168 immediately below the collar deck 125. The floor preferably comprises an assembly of steel plates that are welded together and which extend between sidewalls 134 of the collar deck to cover a substantial part of the interior diameter of the turret. The floor thus improves the structural stability of the turret. The collar deck further comprises a ceiling 133.

Riser deck 165 lies immediately above the collar deck 125, and comprises an opening for passage of a conduit 166 which is connected to or part of a riser line. Flow of hydrocarbons from the conduit 166 to processing equipment on or above the topside process deck can be controlled by means of valve 167.

In order to allow personnel access to the collar deck 125 from the deck directly above or below the collar deck, stairs 131 and 132 are provided. The stairs 131 run from the collar deck 125 to the riser deck 165, and stairs 132 run through an opening in the floor 122 from the collar deck 125 to the deck 168. At the level of the top-side process deck 160 additional bearings 162 are provided. As will be apparent to the skilled person, the bearings 162, in contrast to the axial support bearings 110, are unsuitable for supporting a substantial portion of the weight of the turret or the collar of the turret, but merely provide support for the cover between the turret and the top side process deck of the vessel which covers the opening of the moonpool at the level of the top-side process deck.

Lowering the collar deck has the effect that equipment is located lower in the turret which saves space on the manifold or has a lower manifold. Additionally, in case where the upper part of the turret should be winterized, or encapsulated and ventilated, lowering the collar deck in the moonpool will have the effect to reduce the volumes to be winterized/ventilated and accordingly the weight of winterization panels/air demand and HVAC equipment.

In an embodiment, a riser deck 165 is provided above the collar deck 125. The riser deck 165 is arranged to hold manifold foundations (not shown in detail) such that riser terminations (not shown in detail) are at the level of the topside process deck 160.

Preferably, the riser deck 165 is arranged at substantially the same level as the topside process deck 160, but the skilled in the art will appreciate that the riser deck 165 may be positioned also at an intermediate level between the level of the collar deck 125 and the topside process deck 160.

On the topside process deck 160 above the moonpool 155/turret structure 120, the offshore vessel 150 is equipped with a supporting construction 350 which holds a swivel stack that couples to riser lines and/or other equipment that interacts with the turret structure 120 in the moonpool 155. Such swivel stack and equipment are well known in the art.

Figure 4:
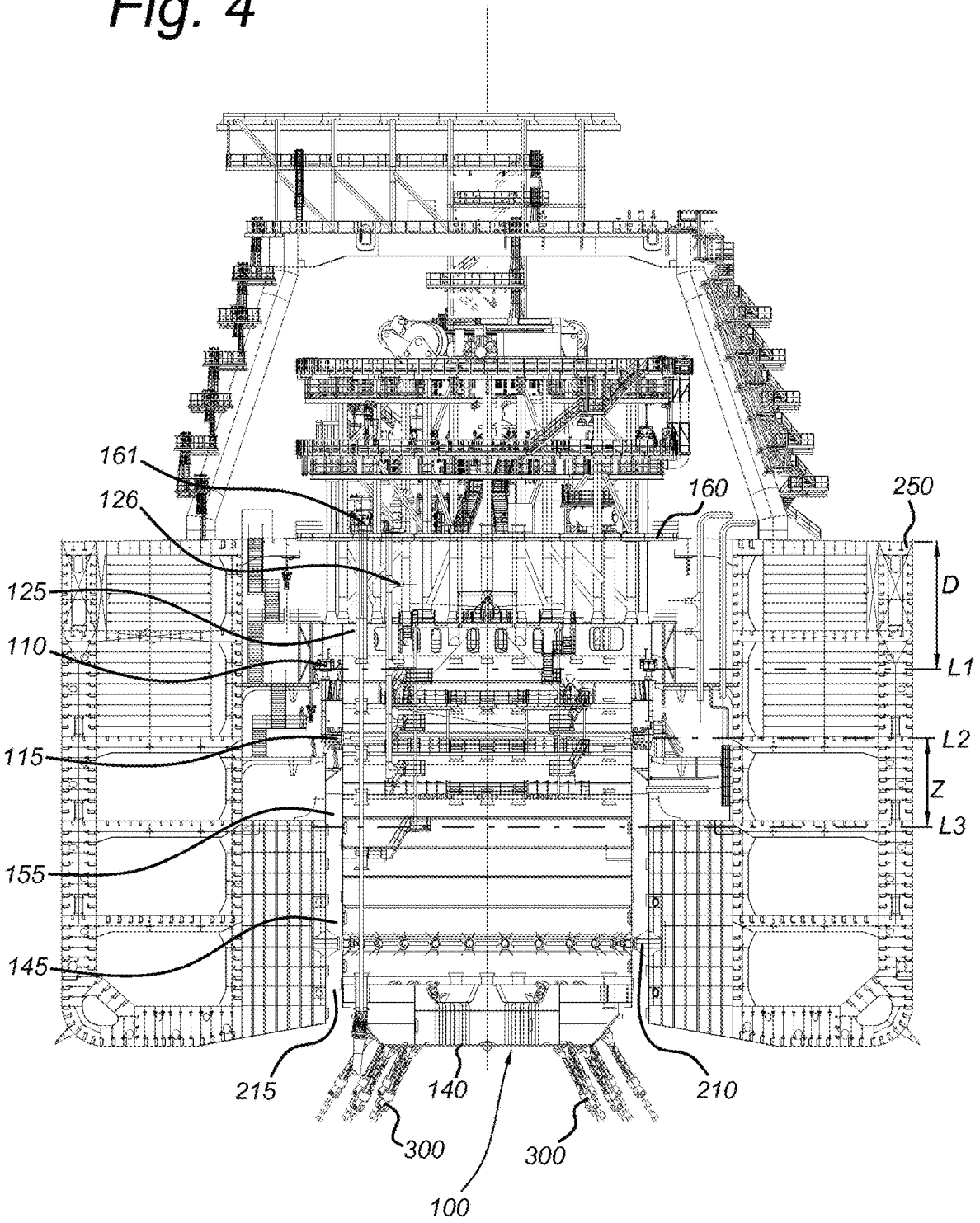
FIG. 4 shows a cross-sectional view of a vessel comprising a turret mooring system according to an embodiment of the invention.

FIG. 4 shows a cross-section of a vessel 250 comprising a turret mooring system 400 according to an embodiment of the invention.

In FIG. 4 entities with the same reference number as shown in the preceding FIGS. 1, 2, 3A, 3B refer to corresponding or similar entities.

FIG. 4 shows that a third type of bearing element, i.e., lower stopper 210 is added at a bottom region 215 of the moonpool 155. The bearing arrangement 110, 115, 210 comprises axial bogies 110, radial wheels 115 and lower stoppers 210 in this embodiment. Lower stoppers 210 are used as stoppers to limit the total load applied to the axial bogies and radial wheels in case of extreme events.

In the embodiments of the invention relating to FIG. 4, instead of a riser deck 165 at substantially the level of the topside process deck 160, the collar deck 125 provides a support for manifold foundations. Manifolds 126 are mounted on the collar deck 125 while riser terminations 161 are provided at the level of the topside process deck 160. Since a braced structure like manifolds typically represents less weight than a turret cylinder of same height, the structural weight of the vessel can be reduced in this respect.

The skilled in the art will appreciate that as shown in FIG. 4 the collar deck 125 lowered in the hull is not a suitable space to locate hydrocarbon production-related equipment, due to the relatively confined area and the required ventilation. However, the collar deck 125 may be adapted to locate equipment that is not a potential hydrocarbon leak source, such as various hydraulic power units, and/or a hook-up winch for mooring lines and/or risers, depending on the selected arrangement for pull-in.

Figure 5A:
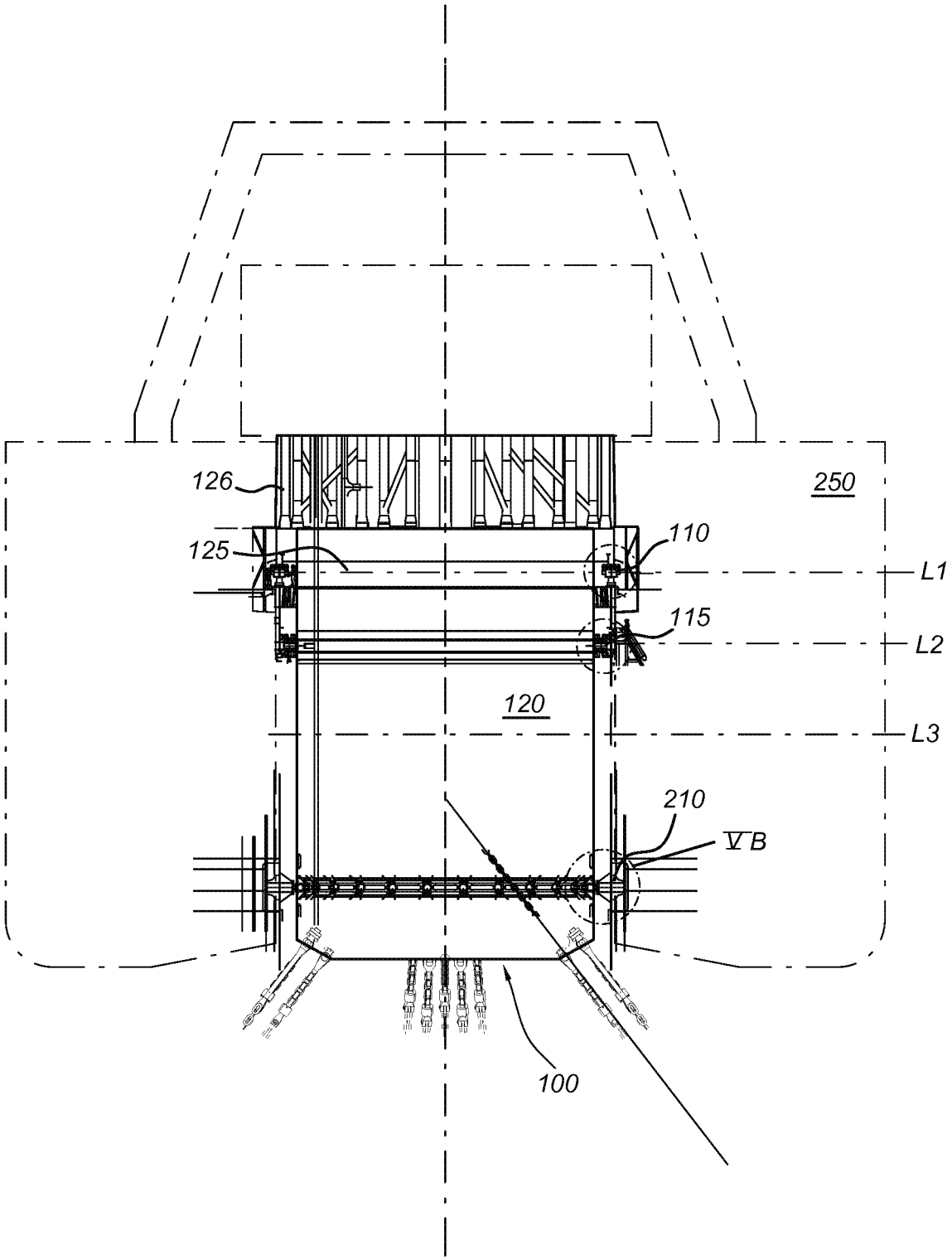
FIG. 5A shows a cross-sectional view of a detail from FIG. 4.

In FIG. 5A a simplified cross-sectional view of FIG. 4 is presented, indicating the vessel 250, the turret 100, the bearing arrangement 110, 115 and the lower stoppers 210. Further the levels of the axial bogie 110, of the radial wheels 115 and the maximum draught line are shown indicated by lines referenced L1, L2 and L3, respectively.

Figure 5B:
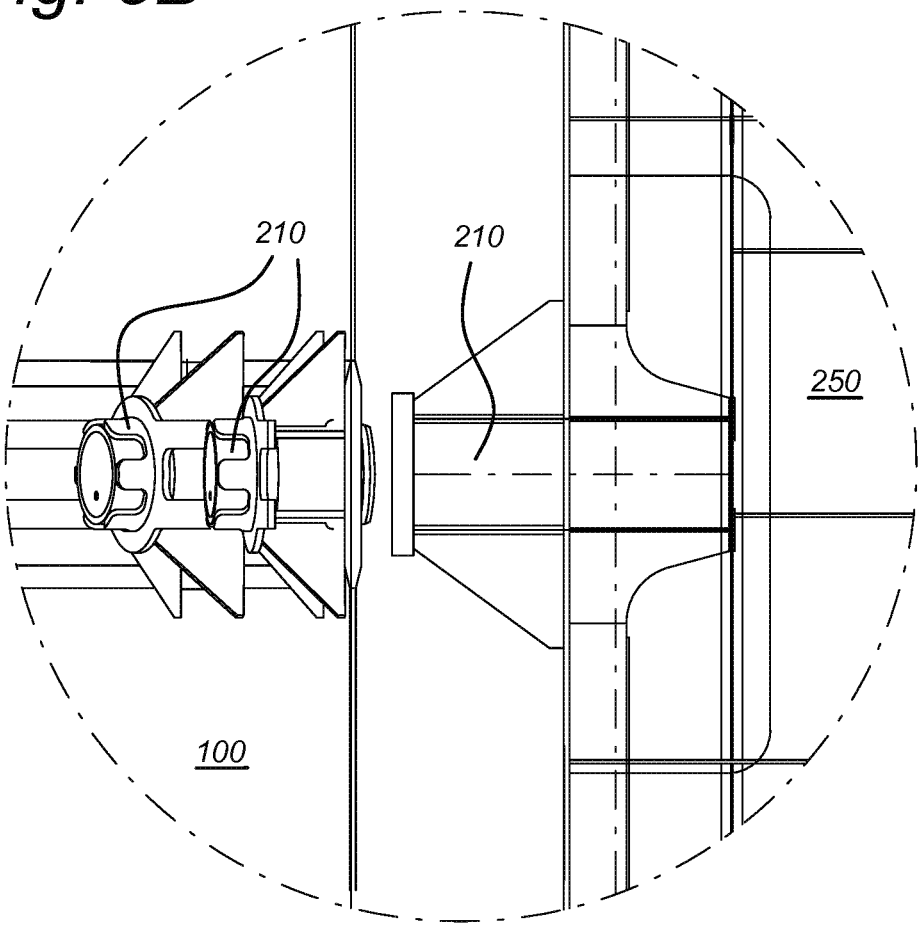
FIG. 5B shows a detail of a bearing structure.

FIG. 5B shows details of the lower stoppers 210, as positioned on the internal moonpool wall of the vessel 250.

The advantages of the invention are the following:

Locating the radial wheels as low as possible (above water level) has the effect of also lowering the loading applied to the axial bogies (hence allows for a reduction of the number of axial bearing elements), Reducing the total height of the lower turret from keel to collar deck and save structural weight thanks to:

Reduction of Bogie Support Structure total height and weight,

Reduction of turret cylinder total height and weight,

Reduction of elevation of the overall turret center of gravity.

The invention has been described with reference to some embodiments. Obvious modifications and alterations will occur to others upon reading and understanding the preceding detailed description. It is intended that the invention be construed as including all such modifications and alterations insofar as they come within the scope of the appended claims.

The invention claimed is:

1. A turret mooring system (100; 400) for a floating process and storage offloading, FPSO, vessel or a FLNG vessel (150; 250), said system comprising:

a turret structure (120); and a bearing support structure (110, 115);

the turret structure to be placed within a moonpool (155) in a hull of the vessel and rotatably held within the moonpool via the bearing support structure, the bearing support structure comprising a radial support (115) and an axial support (110);

the radial support comprising a plurality of radial wheels, the axial support comprising a plurality of axial bogies;

the vessel having a topside process deck (160) and a hull with a bottom (180), wherein the hull has a height of at least 35 meter between the bottom and the topside process deck, wherein the turret structure comprises a collar deck (125) and the collar deck is positioned vertically above an upper side (L1) of the axial support and below an elevation of the topside process deck (160), wherein the bearing arrangement is positioned at a vertical distance (D) below the elevation of the topside process deck (160) such that there is at least one interdeck space of at least 6 meters between the topside process deck (160) and a top level (L1) of the bearing arrangement (110, 115), and wherein said interdeck space is large enough to locate process equipment in said interdeck space, and wherein the radial support is vertically positioned (L2) in the turret structure between the collar deck and a bottom part of the hull, and the axial support is vertically positioned (L1) in the turret structure between the collar deck and the radial support.

2. The turret mooring system according to claim 1, wherein the bearing support structure further comprises a plurality of lower stoppers (210) arranged in a bottom region (215) of the moonpool.

3. The turret mooring system according to claim 2, wherein the lower stoppers are arranged at vertical distance of about 5 meter from the bottom opening (180) of the moonpool (155).

4. The turret mooring system according to claim 1, wherein the collar deck is separated from the topside process deck by at least one interdeck distance (170).

5. The turret mooring system according to claim 1, wherein the collar deck is separated from the topside process deck by an intermediate element (165).

6. The turret mooring system according to claim 5, wherein the intermediate element comprises at least one of a riser termination deck (165) and a manifold structure.

7. The turret mooring system according to claim 6, wherein risers terminate at either the collar deck or the top side process deck.

8. The turret mooring system according to claim 1, wherein the collar deck (125) sits on the axial bogies of the axial support (110).

9. The turret mooring system according to claim 1, further comprising a lip seal (130) and/or a water damming labyrinth (135) between the radial support and the bottom (180) of the hull.

10. The turret mooring system according to claim 9, wherein the radial support (110) is positioned (L2) above a designed maximum draught level (L3), said maximum draught level (L3) accounting for the sea water dynamic motions, to prevent exposure of radial wheels mechanical components to sea water.

11. The turret mooring system according to claim 10, wherein the lip seal and/or water damming labyrinth is vertically positioned between the designed maximum draught level (L3) of the vessel and the level of the radial support (L2).

12. The turret mooring system according to claim 1, wherein said collar deck comprises a floor, sidewalls and a ceiling, and is accessible from another deck of the turret which lies directly above the collar deck.

13. The turret mooring system according to claim 1, wherein the turret structure is a mooring buoy.

14. A FPSO or FLNG vessel comprising a hull and a turret mooring system, the turret mooring system comprising a turret structure and a bearing support structure wherein the turret structure is rotatably suspended from the hull of the vessel, the turret mooring system in accordance with claim 1.

15. The turret mooring system according to claim 2, wherein the collar deck is separated from the topside process deck by at least one interdeck distance (170).

16. The turret mooring system according to claim 3, wherein the collar deck is separated from the topside process deck by at least one interdeck distance (170).

17. The turret mooring system according to claim 2, wherein the collar deck is separated from the topside process deck by an intermediate element (165).

18. The turret mooring system according to claim 3, wherein the collar deck is separated from the topside process deck by an intermediate element (165).

19. The turret mooring system according to claim 4, wherein the collar deck is separated from the topside process deck by an intermediate element (165).

* * * * *